US006338179B1

(12) United States Patent
Blackstone

(10) Patent No.: US 6,338,179 B1
(45) Date of Patent: Jan. 15, 2002

(54) CARPET ROD BRACKETS AND CARPET ROD ASSEMBLIES USING THE SAME

(76) Inventor: Warren Blackstone, 1401 Oak Lawn, Dallas, Dallas County, TX (US) 75207

( * ) Notice: Subject to any disclaimer, the term of this patent is extended or adjusted under 35 U.S.C. 154(b) by 0 days.

(21) Appl. No.: 09/654,862

(22) Filed: Sep. 5, 2000

(51) Int. Cl.[7] ..... A47G 27/06
(52) U.S. Cl. ..... 16/12; 16/10; 16/15
(58) Field of Search ..... 16/10–15; 248/267, 248/262, 254, 251

(56) References Cited

U.S. PATENT DOCUMENTS

| | | | | | |
|---|---|---|---|---|---|
| 86,092 | A | | 1/1869 | Mersereau | |
| 87,662 | A | | 3/1869 | Gould | |
| 269,181 | A | | 12/1882 | Cowing | |
| 304,951 | A | * | 9/1884 | Nobes | 16/15 |
| 484,708 | A | | 10/1892 | Gates | |
| 701,394 | A | * | 6/1902 | Richards | 16/15 |
| 737,143 | A | * | 8/1903 | Richards | 16/15 |
| 795,590 | A | | 7/1905 | Draper | |
| 805,307 | A | * | 11/1905 | Mallen | 16/15 |
| 869,492 | A | | 10/1907 | Joyner | |
| 928,607 | A | | 1/1909 | Jackson | |
| 980,646 | A | | 1/1911 | Kroder | |
| 1,216,602 | A | | 2/1917 | Petrusha | |
| 1,385,311 | A | * | 7/1921 | Dupont | 16/10 |
| 1,397,618 | A | * | 11/1921 | Burns | 16/12 |
| 1,624,392 | A | | 4/1927 | Cleverly | |
| D342,437 | S | | 12/1993 | Prezner | D8/380 |
| 5,960,516 | A | | 10/1999 | Zoroufy et al. | 16/12 |

* cited by examiner

*Primary Examiner*—Chuck Y. Mah
(74) *Attorney, Agent, or Firm*—James J. Murphy, Esq.; Winstead Sechrest & Minick

(57) ABSTRACT

A bracket 107 for retaining a stair rod 106 includes a first portion 301*b* for affixing to a stair including means 304 for securing a finial thereto and a seat 301/302 for receiving an end of the corresponding stair rod 106. A second portion 301*b* is rotatably coupled to the first portion 301*a* and includes means for retaining the end of corresponding stair rod 106 in the seat of the first portion 301*a* of bracket 107. Means 402 are also provided for holding the first and second portions of the bracket in engagement.

20 Claims, 5 Drawing Sheets

CARPET ROD BRACKETS AND CARPET ROD ASSEMBLIES USING THE SAME

BACKGROUND OF THE INVENTION

1. Field of the Invention

The present invention relates in general to carpeting and in particular to Carpet rod brackets and carpet rod assemblies using the same.

2. Description of the Related Art

It is often desirable, for both functional and aesthetic reasons, to lay a carpet runner across one or more stair steps in a staircase. On the functional side, carpeting protects the surface of the stair step, such as the wood surfaces typically found in private residences, from the wear and tear associated with normal foot traffic. Additionally, carpeting provides for a softer, more secure footing for those walking up or down the staircase. In regard to aesthetics, carpets come in a multitude of colors, patterns and materials providing a wide range of decorating options. In any case, carpet runners can be removed and replaced should they become worn or if there is a change in decorating taste.

When a carpet runner is used on a staircase, stair rods are often used to hold the runner in place. The typical stair rod comprises a rod longer than the width of the carpet runner which it is securing. Once the carpet runner is laid across a given stair step, this rod is placed at the bend between the horizontal plane of the stair step and the vertical plane extending upward to the next stair in the staircase. Brackets at the end of the rod hold the rod and the underlying carpet firmly in place. Stair rods are not only important for aesthetic reasons, such as keeping the runner centered along the stair step and providing additional ornamentation, but more importantly for safety reasons. Slippage of the carpet runner under the foot of a pedestrian can cause potentially dangerous slips and falls, as well as twisted ankles and other injuries.

Stair rod brackets must hold the rod securely in place with minimal slippage either along the longitudinal axis of the rod or at an angle thereto. One such bracket system is shown in U.S. Pat. No. 5,960,516 to Zoroufy et al. Here, the rod mates with a pair of slidably interconnecting brackets at each end. An inner bracket is fastened to the horizontal and vertical surfaces of the stair, while an outer bracket slides over the first bracket. A finial extends through the wall of the outer bracket and an end-stop of the inner bracket to engage a tapped (threaded) aperature in the end of the rod. This system is secure, but is more complicated to assemble or disassemble, should it be necessary to remove the rod for carpet cleaning or replacement.

Another type stair rod bracket system is disclosed in U.S. Pat. No. 342,437 to Prezner and U.S. Pat. No. 869,492 to Joyner. This system uses a hinged clamps which are secured to the stair and which open to receive the stair rod. Once the rod is in place, the clamp is fastened closed around the rod. The rod extends completely though the clamp and is thus susceptible to lateral slippage. Moreover, the finial must be affixed to the rod itself, when used.

Another disadvantage of some commercially available stair rod systems is a result of the use of lead in their construction. Specifically, lead is sometimes used in the expansion screw used to fasten the finial to the stair rod. As is well known, lead and similar heavy metals are hazardous, especially with respects to children who often play on the stairs.

What is needed therefore is a stair rod system which is easy to assemble and disassemble such that the carpet can be easily accessed for cleaning or replacement. Such as system should hold the rod securely in place thereby minimizing slippage or movement of the rod when weight is placed on the underlying carpet. Additionally, the use of lead expansion screws should be eliminated. Finally, such a system should include ornamental features which allow the stair rod to blend in easily with the given decorative scheme.

SUMMARY OF THE INVENTION

According to one embodiment of the principles of the present invention, a bracket is disclosed for retaining a stair rod. The bracket includes a first portion for affixing to a stair, including means for securing a finial thereto, and a seat for receiving an end of the corresponding stair rod. A second portion of the bracket is rotatably coupled to the first portion and includes means for retaining the end of the corresponding stair rod in the seat of the first portion of bracket. Means are also included for holding the first and second portions of the bracket in engagement.

Brackets and stair rod assemblies using the same have substantial advantages over the prior art. Among other things, since the finial is attached to the bracket, rather than to the rod, the stair rod can more easily be handled during carpet replacement or cleaning. Moreover, it is only necessary to release a simple key or latch to free the stair rod from its brackets. Additionally, carpet rod brackets and carpet rod assemblies using the same minimize slippage and other unwanted movement such that the underlying carpet is securely held in place on the stairway. Finally, implementation of the inventive concepts does not require the use of lead expansion screws or similar parts constructed of hazardous materials.

BRIEF DESCRIPTION OF THE DRAWINGS

For a more complete understanding of the present invention, and the advantages thereof, reference is now made to the following descriptions taken in conjunction with the accompanying dr wings, in which.

DESCRIPTION OF THE PREFERRED EMBODIMENTS

The principles of the present invention and their advantages are best understood by referring to the illustrated embodiment depicted in FIGS. 1–4 of the drawings, in which like numbers designate like parts.

Figure 1:
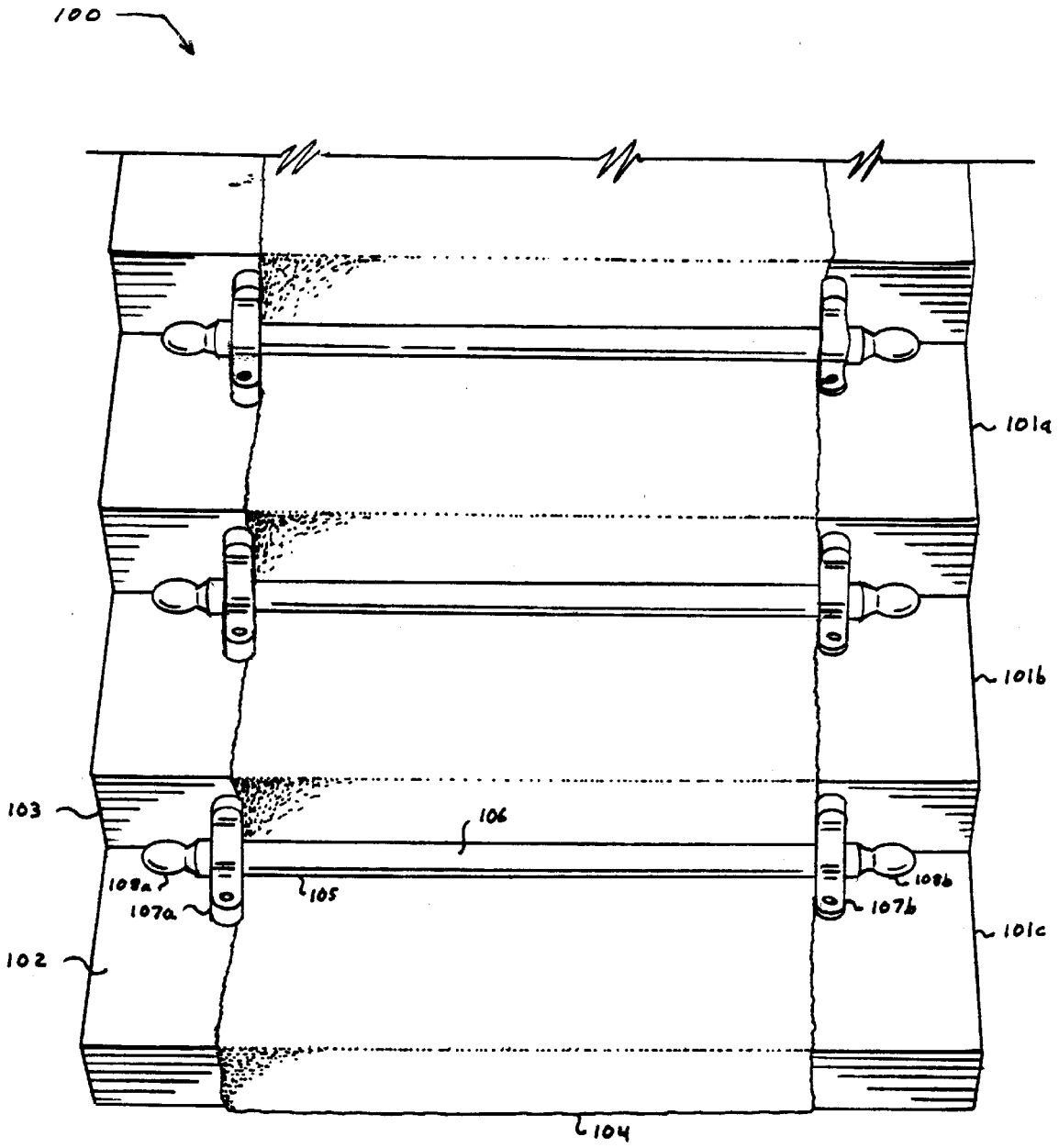
FIG. 1 is a diagram illustrating a selected number of stair rod assemblies according to the inventive concepts as used to secure a carpet running to a corresponding set of stair step.

FIG. 1 is a diagram of a portion of a staircase 100 including three stair steps 101*a,c*. Each stair step includes a horizontal surface 102 spaced from the horizontal surfaces 102 of the adjacent stair step by a vertical surface 103. In this example, a carpet runner 104 is disposed along the depicted length of staircase 100 and generally centered within the lateral boundaries of stair steps 101*a,c*. For illustrative purposes, carpet runner 104 is a generic carpet runner of solid color widely available from most carpet retailers.

At the intersection of the horizontal surface 102 and vertical surface 103 of each stair step of staircase 100 is a stair rod assembly 105 in accordance with the inventive concepts. Each stair rod assembly 104 includes a stair rod 106 held securely against the surface of carpet runner 104 by a set of brackets 107*a,b* disposed at the opposing ends of rod 106. A decorative finial 108*a, b* is provided fastened to the outward facing surfaces of brackets 107. Brackets 107 are fastened to the surfaces 102,103 of the corresponding stair step 101 by screws or similar fasteners known in the art.

Figure 2:
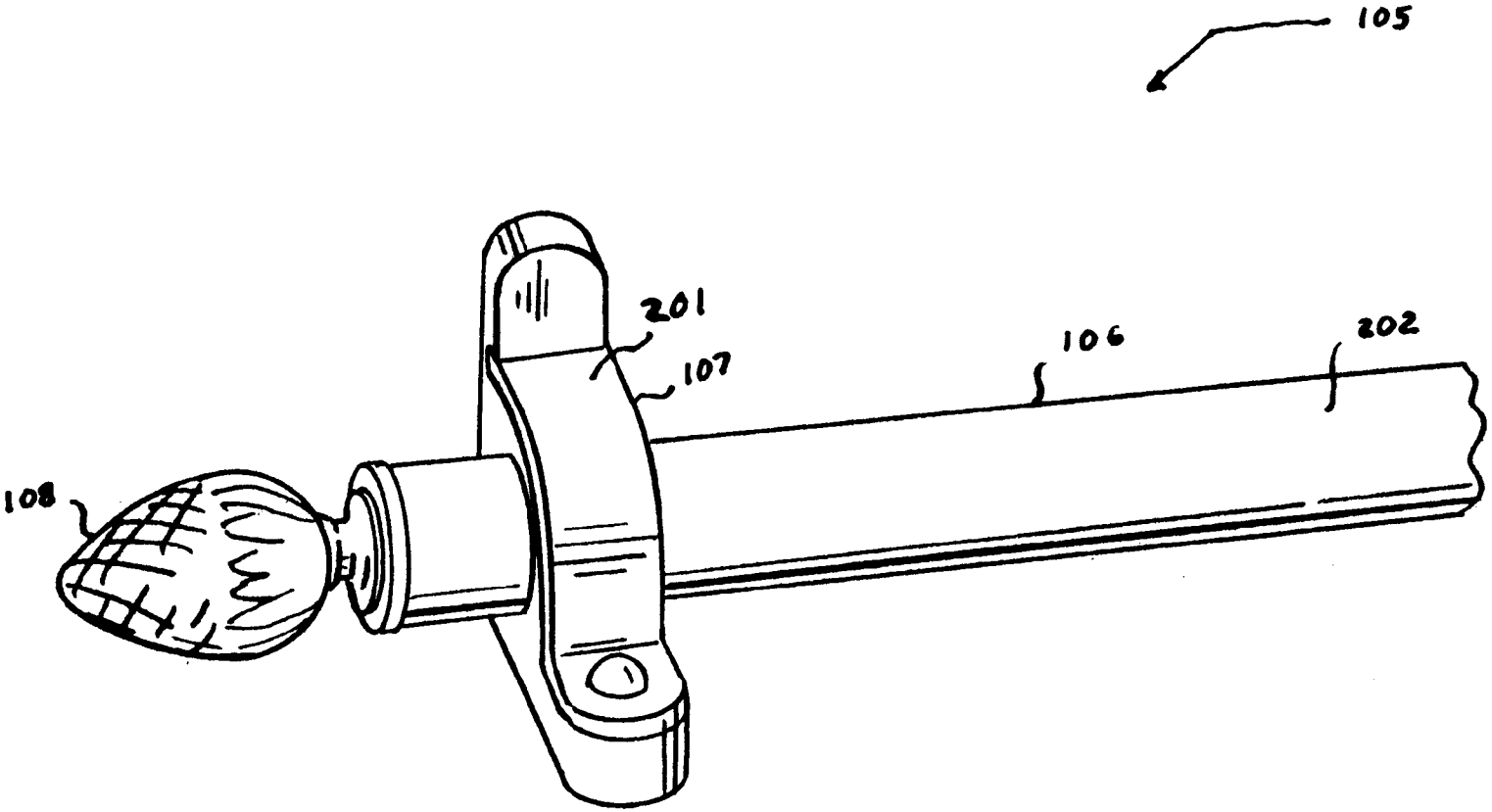
FIG. 2 is a more detailed view of a portion of the stair rod, the bracket and finial of a selected one of the assemblies depicted in FIG. 1.

A more detailed view of an end portion of a selected stair rod assembly 106 is shown in FIG. 2. Rod 106 can be constructed of any one of a number of materials depending on the desired decorative impression. For example, rod 106 could be constructed out of metal or plastic with a metallic finish such as polished brass, antique brass, pewter or chrome. Rod 106 may also be constructed from a transparent or semi-transparent material such as acrylic or other plastic. The rod may be tubular or solid and have a circular or quarter round cross-section. The face surface 202 of the rod 106 shown in FIG. 2 is smooth, although alternatively this surface could be reeded, decorated with a spiral (rope) design running down its length or otherwise ornamented. (An example of a reeded rod is provided in FIG. 3).

Brackets 107 and finials 108 are preferably constructed from material similar to those used to construct rod 106. In FIG. 2, the face surface 201 of the depicted bracket is smooth, although this surface may also include a design or other ornamentation. The depicted finial is oblong-shaped with a ornamental design, although many different types of finials are available, including those with smooth or undecorated surfaces and/or which are spherical-shaped, knob-shaped or urn-shaped, to name a few options.

Figure 3:
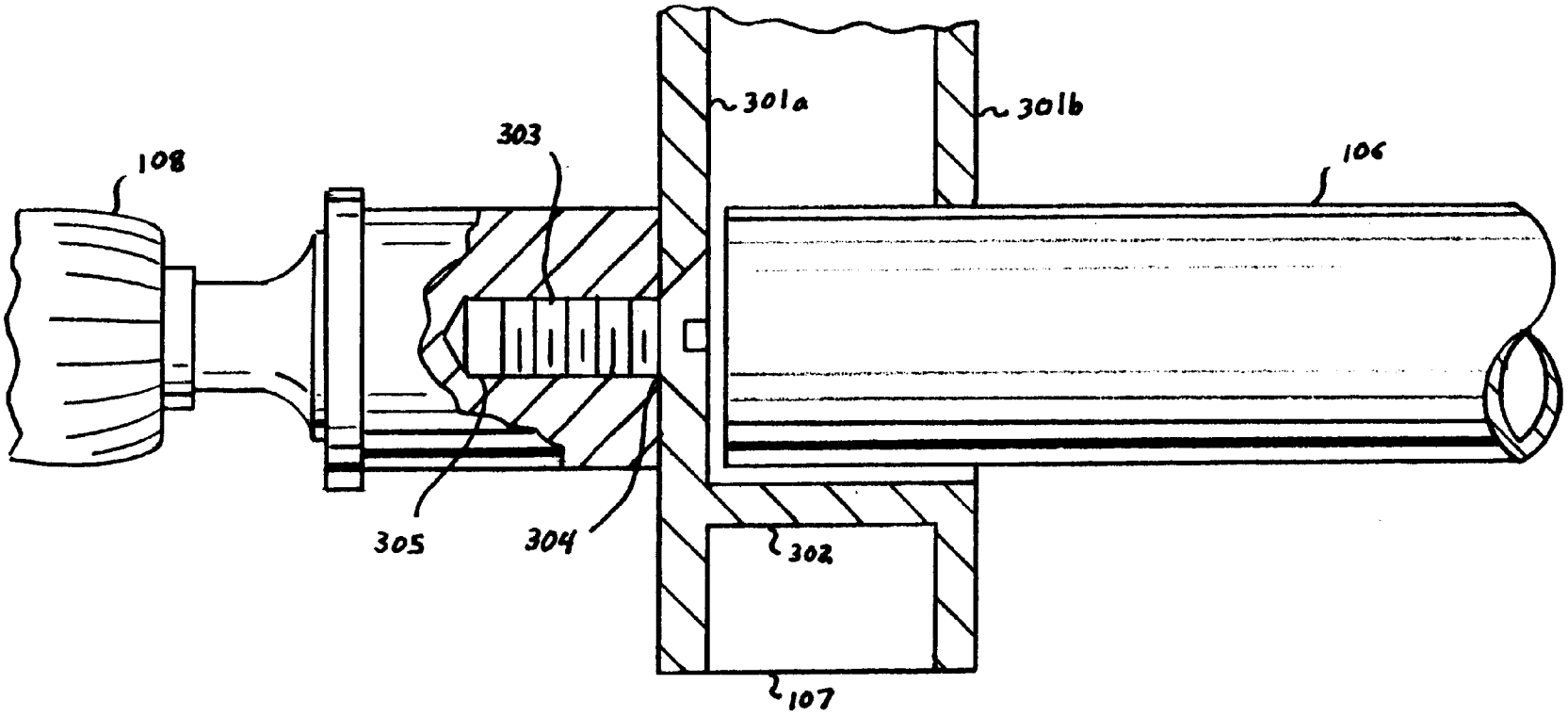
FIG. 3 is an enlarged cross-sectional view of the stair rod-bracket interface shown in FIG. 2, along with the attachment of the finial to the bracket, according to the inventive concepts.

FIG. 3 is a cross-sectional view of one of the brackets 107 demonstrating its relationship with rod 106 and the corresponding finial 108, according to the inventive concepts. (The hinging mechanism will be illustrated in detail in conjunction with FIGS. 4A–4C). In this view, the face surface 201 has been cut-away.

According the invention, finial 108 is fastened to the outer sidewall 301*a* by a machine screw 303. In the illustrated embodiment, screw 303 extends through an countersunk aperature 304 through sidewall 301a and mates with a tapped (threaded) aperature 305 in finial 108. Advantageously, finial 108 independent of rod 106. Advantageously, screw 303 does not have to be, and is preferably not, a lead expansion screw.

As shown in FIG. 3, the end of rod 106 is seated within the sidewalls 301*a,b* and 302 of bracket 107 and is held by the hinging action. Preferably, the seat formed by sidewalls 301*a,b* and 302 is circular, with one semicircle defined by the sidewalls of one hinged half of the bracket and the other semicircle defined by the sidewalls of the other hinged half of the bracket. Two hinging mechanisms are possible according to the inventive principles. As shown in the side views of FIGS. 4A and 4B, according to one embodiment, sidewall 301*a* and the finial attached thereto are held fixed (the finial is not shown for clarity; however, the corresponding mating aperature 304 and the finial mounting surface 405 is depicted for reference). Sidewall 301*b* and face surface 201 then rotate or pivot around a pin, screw or similar rotation mechanism 401. The closed configuration is shown in FIG. 4A and the open configuration in FIG. 4B. A fastener 402, in this example is a key disposed in the fixed half of bracket 107 which rotates with respects to a corresponding aperature within the movable half of bracket 106, holds the end of rod 107 firmly within the confines of bracket 107.

A second embodiment is shown in FIG. 3, where sidewall 301*a* and upper surface 201, and the finial when attached, rotate while sidewall 301*b* remains fixed. In this view, the screws or fasteners 403*a,b,* used to fasten bracket 107 to the corresponding stair 101, are shown for reference.

Figure 4B:
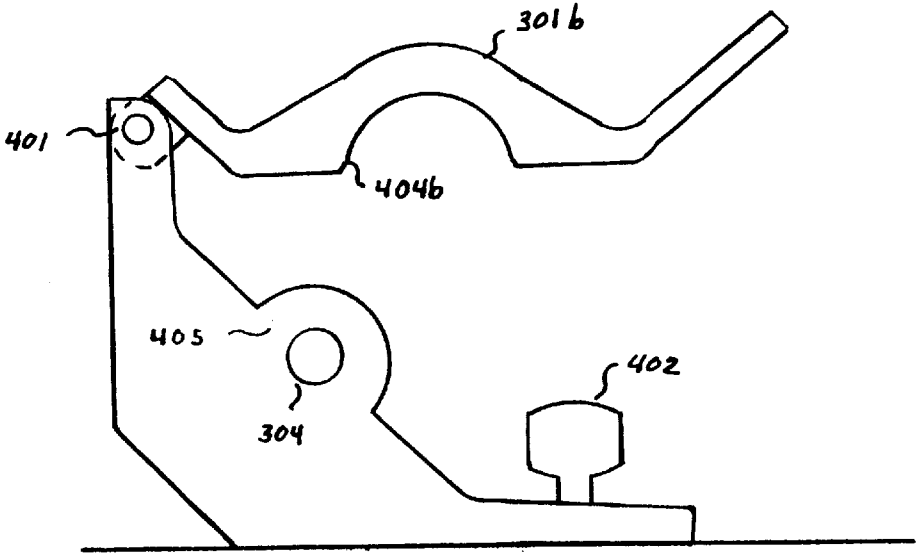
FIGS. 4A and 4B, are more detailed diagrams depicting the hinging action of a selected one of the brackets of FIG. 1 in accordance with one embodiment of the inventive concepts.
Figure 4A:
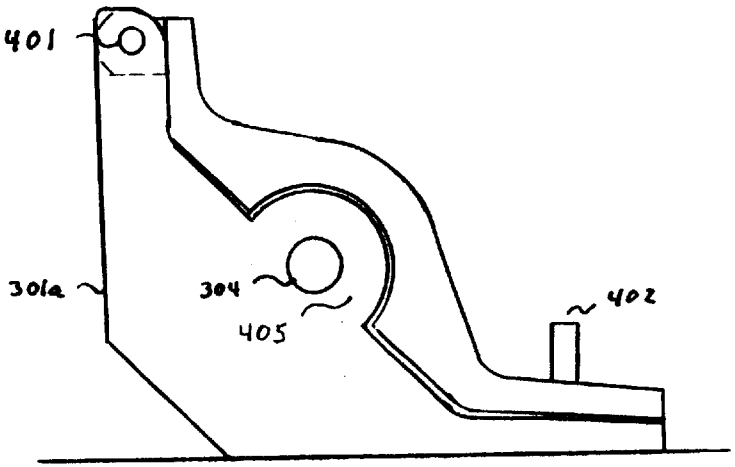
Figure 4C:
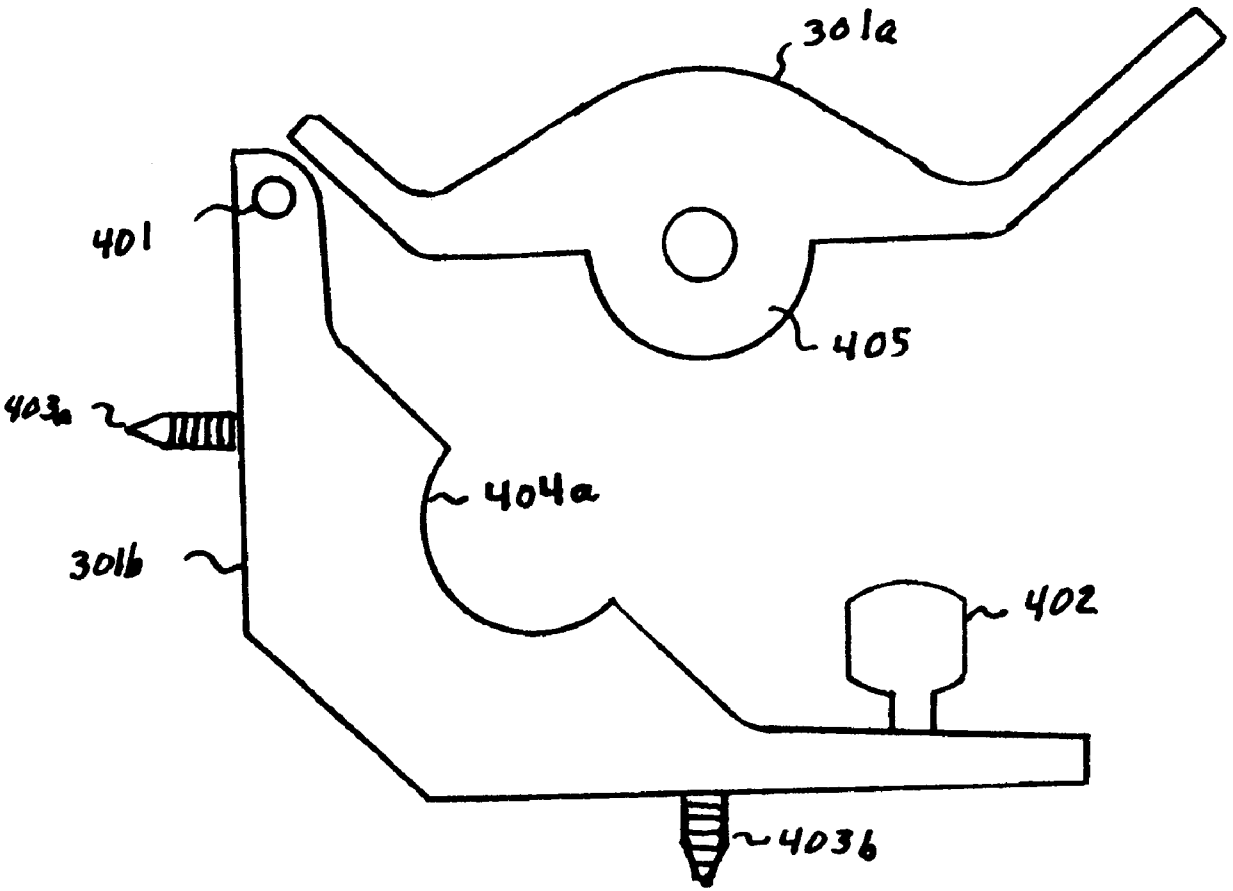
FIG. 4C are more detailed diagrams depicting the hinging action of a selected one of the brackets of FIG. 1 in accordance with a second embodiment of the inventive concepts

FIGS. 4A–4C also show the circular seat defined to retain the corresponding end of stair rod 106. One half (semicircle) 404*a* is defined by the fixed (lower) half bracket while the other half (semicircle) 404*b* is defined by the rotatable upper half bracket. It should also be noted that while the rotation mechanism 401 is disposed at the upper ends of the half-brackets and the fastener or key 402 at the lower ends of the half-brackets in the illustrated embodiments, fastener 402 and rotation mechanism 401 can be swapped in alternate embodiments. Referring to FIGS. 4A and 4B for example, the free end of the upper half bracket would then rotate to the right and ultimately downward instead of upward and ultimately to the left.

The various embodiments of the present inventive principles have substantial advantages over the prior art. Among other things, the stair rod is held securely, even under foot traffic, with minimal slippage. The finial is attached to the bracket and therefore can be selected or interchanged independent of the selection or interchange of the rod itself. Additionally, the rod can be more easily removed and handled without the finials during carpet runner replacement or cleaning.

Although the invention has been described with reference to a specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore, contemplated that the claims will cover any such modifications or embodiments that fall within the true scope of the invention.

What is claimed:

1. A bracket for retaining a stair rod comprising:

a first portion for affixing to a stair including means for securing a finial thereto and a seat for receiving an end of a corresponding stair rod;

a second portion rotatably coupled to said first portion and including means for retaining said end of said corresponding stair rod in said seat of said first portion of said bracket; and means for holding said first and second portions of said bracket in engagement.

2. The bracket of claim 1 wherein said means for securing a finial comprises a surface for contacting a surface of said finial and an aperature for receiving a screw for engaging a corresponding tapped aperature in said finial.

3. The bracket of claim 2 and further comprising a finial secured to said first portion of said bracket with a screw received through said aperature.

4. The bracket of claim 1 wherein said second portion has a distal end rotatably coupled to said first portion by a pin.

5. The bracket of claim 1 wherein said means for holding comprises a rotatable key fastened to said first portion of said bracket for extending though a corresponding aperature in said second portion of said bracket in a first position and locking said first and second portions of said bracket together when rotated thereafter to a second position.

6. The bracket of claim 1 wherein said means for retaining said end of said rod comprises a semicircular area of said second portion of said bracket having a radius approximating a radius of the corresponding rod.

7. A stair rod bracket comprising:

a lower half-bracket for affixing to a stair and a defining a lower part of a seat for receiving an end of a corresponding stair rod;

an upper half-bracket rotatably coupled to the lower half bracket and defining an upper part of a set for receiving the end of the stair rod, said upper half bracket including means for attaching a finial thereto; and fastener means for securely engaging the end of the corresponding stair rod in the seat defined by the upper and lower half brackets.

8. The stair rod bracket of claim 7 wherein said upper part of the seat comprises a semicircle having a radius selected to conform to the end of the corresponding stair is rod.

9. The stair rod bracket of claim 7 wherein said lower part of the seat comprises a semicircle having a radius selected to conform to the end of the corresponding stair rod.

10. The stair rod bracket of claim 7 wherein a first end of the lower half bracket is rotatably coupled to a first end of the upper half bracket and the fastener is disposed at second opposing ends of the upper and lower halfbrackets.

11. The stair rod bracket of claim 10 wherein said the first ends of the upper and lower half brackets are adapted for affixation to a substantially vertical surface of a stair.

12. The stair rod bracket of claim 7 wherein the means for attaching a finial to the upper half bracket comprises a surface having an aperature there through for receiving a mounting screw.

13. The stair rod bracket of claim 7 and further comprising a finial attached to the upper bracket by the means for attaching.

14. A stair rod assembly comprising:

a stair rod for securing a carpet runner to a stair step;

first and second brackets for securing first and second ends of the stair rod to the stair step each comprising:

a first half-bracket adapted to be affixed to the stair step and defining lower part of a seat adapted to receive an end of the stair rod; and a second half-bracket rotatably coupled to the first half-bracket and defining an upper part of a seat adapted to receive an end of the stair rod, a selected one of the first and second brackets including means for affixing a finial thereto.

15. The stair rod assembly of claim 14 wherein said means for affixing is included with the first half-bracket and the first half-bracket of a selected one of the brackets further comprises an finial attached thereto.

16. The stair rod assembly of claim 14 wherein said means for affixing is included with the second half-bracket and the second half-bracket of a selected one of the brackets further comprises an finial attached thereto.

17. The stair rod assembly of claim 14 wherein the means for affixing a finial comprises a surface with an aperature disposed there through.

18. The stair rod assembly of claim 14 wherein the brackets are constructed of metal.

19. The stair rod assembly of claim 14 wherein said stair rod is cylindrical.

20. The stair rod assembly of claim 14 wherein the stair rod is constructed of metal.

* * * * *